US009987519B2

(12) United States Patent
Snyderman

(10) Patent No.: US 9,987,519 B2
(45) Date of Patent: Jun. 5, 2018

(54) EXERCISE DEVICE

(71) Applicant: M&S Distribution, Inc., Boston, MA (US)

(72) Inventor: Leonard Snyderman, Cohasset, MA (US)

(73) Assignee: M & S Distribution, Inc., Boston, MA (US)

( * ) Notice: Subject to any disclaimer, the term of this patent is extended or adjusted under 35 U.S.C. 154(b) by 0 days. days.

(21) Appl. No.: 15/067,987

(22) Filed: Mar. 11, 2016

(65) Prior Publication Data

US 2016/0263434 A1 Sep. 15, 2016

Related U.S. Application Data

(60) Provisional application No. 62/131,276, filed on Mar. 11, 2015.

(51) Int. Cl.
*A63B 22/06* (2006.01)
*A63B 23/04* (2006.01)
(Continued)

(52) U.S. Cl.
CPC ..... *A63B 23/0476* (2013.01); *A63B 22/0015* (2013.01); *A63B 22/04* (2013.01); *A63B 22/0605* (2013.01); *A63B 2022/0028* (2013.01); *A63B 2022/0611* (2013.01); *A63B 2022/0629* (2013.01); *A63B 2022/0647* (2013.01)

(58) Field of Classification Search
CPC . A63B 23/0476; A63B 22/0015; A63B 22/04; A63B 22/0605; A63B 22/0048; A63B 22/0056; A63B 22/0061; A63B 22/0064; A63B 22/0066; A63B 22/0069; A63B 22/06; A63B 22/0676; A63B 22/0682; A63B 22/0688; A63B 22/0694; A63B 22/14; A63B 23/035; A63B 23/04; A63B 23/0405; A63B 23/0417; A63B 23/0729; A63B 23/0447
See application file for complete search history.

(56) References Cited

U.S. PATENT DOCUMENTS 5,267,922 A * 12/1993 Robinson ..... A63B 22/205 482/53
5,336,147 A * 8/1994 Sweeney, III ..... A63B 22/0012 482/57

(Continued)

OTHER PUBLICATIONS

International Preliminary Report on Patentability for PCT/US16/22178, established May 18, 2017 by PCT/IPEA/US, 10 pages.

*Primary Examiner* — Loan H Thanh
*Assistant Examiner* — Megan Anderson
(74) *Attorney, Agent, or Firm* — Alan M. Sack; Kimberley Elcess; SACK IP Law p.c.

(57) ABSTRACT

An improved exercise device includes pedals configured to move in counter-rotating circles in a plane inclined toward the horizontal from the vertical at an angle greater than 0° and less than or equal to 90°. The device includes a supporting frame, a pedal mounting assembly attached to the supporting frame at an angle from the vertical, two pedal supports attached to the pedal mounting assembly, each via a pedal crank assembly, at an angle to the vertical, and two pedals, one pedal supported by each pedal support.

9 Claims, 10 Drawing Sheets

(51) Int. Cl.
*A63B 22/00* (2006.01)
*A63B 22/04* (2006.01)

(56) References Cited

U.S. PATENT DOCUMENTS

| | | | | | |
|---|---|---|---|---|---|
| 5,518,474 | A * | 5/1996 | Barksdale | A63B 21/0087 | 482/112 |
| 5,595,554 | A * | 1/1997 | Maresh | A63B 21/157 | 482/52 |
| 6,234,935 | B1 * | 5/2001 | Chu | A63B 21/018 | 482/51 |
| 7,621,849 | B1 * | 11/2009 | Tsai | A63B 21/0552 | 482/51 |
| 2005/0014609 | A1 | 1/2005 | Neff | | |

* cited by examiner

EXERCISE DEVICE

CROSS-REFERENCE TO OTHER APPLICATIONS

This application claims priority to U.S. Provisional Patent Application No. 62/131,276, filed on 11 Mar. 2015, which is incorporated by reference in its entirety.

BACKGROUND

This invention relates to an improvement in the use and mounting of a foot pedal-operated exercise machine in which two side-by-side pedal units are arranged to rotate in a vertical plane that is parallel to another vertical plane that passes through the user's bilateral axis. Furthermore, this invention relates to structural modifications and mounting arrangements of the pedals to provide a pedal-motivated exercise device, that utilizes side-by-side rotation with an additional component of front-to-back rotation of traditional bicycle-style exercise machines.

U.S. Pat. No. 7,108,638 ("Snyderman '638") and US Patent Application Publication No. 2014/0357454 ("Snyderman '454"), each of which is incorporated by reference in its entirety, disclose exercise devices that provide resistance when a user moves foot pedals in a side-to-side circular path. In these devices, the pedals are mounted perpendicular to a support or frame that is itself positioned vertically. That is, the frame defines a plane oriented at 90° to the horizontal, usually a floor or other support surface, and the pedals are mounted in a position parallel to the horizontal at 90° to the frame. The plane through which the pedals move in a circular path is parallel to that of the frame and perpendicular to a horizontal plane. As the user moves the pedals, resistance is provided to the user's leg abductor muscles as the pedals move laterally, away from the midpoint of the user's body, and to the user's leg adductor muscles as the pedals move medially, toward the midpoint of the user's body. During proper use of these devices, forward and backward motion of the feet and legs is almost non-existent.

This pedal movement is useful for individuals wishing to exercise particular leg muscles in this fashion. This type of exercise can be especially useful for skaters, skiers, and other athletes desiring to exercise particular muscle groups that might not otherwise be strengthened by exercising on traditional exercise devices that provide resistance to muscles involved in forward and backward motion of the feet and legs. As experience has been gained with the Snyderman exercise devices, however, it has become clear that a certain threshold fitness level is required for their use. Not everyone who could benefit from the lateral exercise has the initial strength or endurance in the abductor and adductor muscles to execute and maintain the necessary lateral motion long enough for benefit to accrue.

While the benefits of lateral motion resistance exercise has been recognized in recent years, there remain challenges in bringing these benefits to the public at large.

SUMMARY

The invention described and claimed in this specification provides the benefits of lateral resistance to exercise the abductor and adductor muscles of the user, while more heavily recruiting muscles involved in forward and backward motion of the feet and legs, to allow a user to maintain the lateral effort at reduced intensity when compared to that required by prior art exercise devices. In another embodiment, the intensity of the exercise can be increased or decreased to match the user's fitness level or desired intensity of the exercise. These improvements are accomplished by modifying the orientation of the plane of the circular motion of the pedals.

In some embodiments, the improved exercise device includes a supporting frame; a pedal mounting assembly attached to the supporting frame at a tilt angle to the vertical, the tilt angle having a value greater than 0° and less than or equal to 90°; two pedal supports, each pedal support affixed to the pedal mounting assembly at an attachment angle, the attachment angle having a value greater than 0° and less than or equal to 90°; and two pedals, one pedal attached to and supported by each pedal support. In some embodiments the attachment angle is adjustable. In other embodiments the attachment angle is fixed. In some embodiments the tilt angle is fixed. In other embodiments the tilt angle is adjustable. In some embodiments the attachment angle is equal to the tilt angle. In some embodiments both the attachment angle and the tilt angle have values greater than 0° and less than or equal to 45°. In some embodiments both the attachment angle and the tilt angle have values equal to 38°.

In some embodiments each pedal support is configured to maintain its pedal at a fixed distance from the axis around which the pedal support rotates. In other embodiments this fixed distance is adjustable.

This, being a summary, is necessarily brief and does not set forth all of the features and advantages of the novel exercise device, its method of making, or its use. The invention may be more fully understood with reference to the drawings and the detailed description that follow.

DETAILED DESCRIPTION

Figure 1:
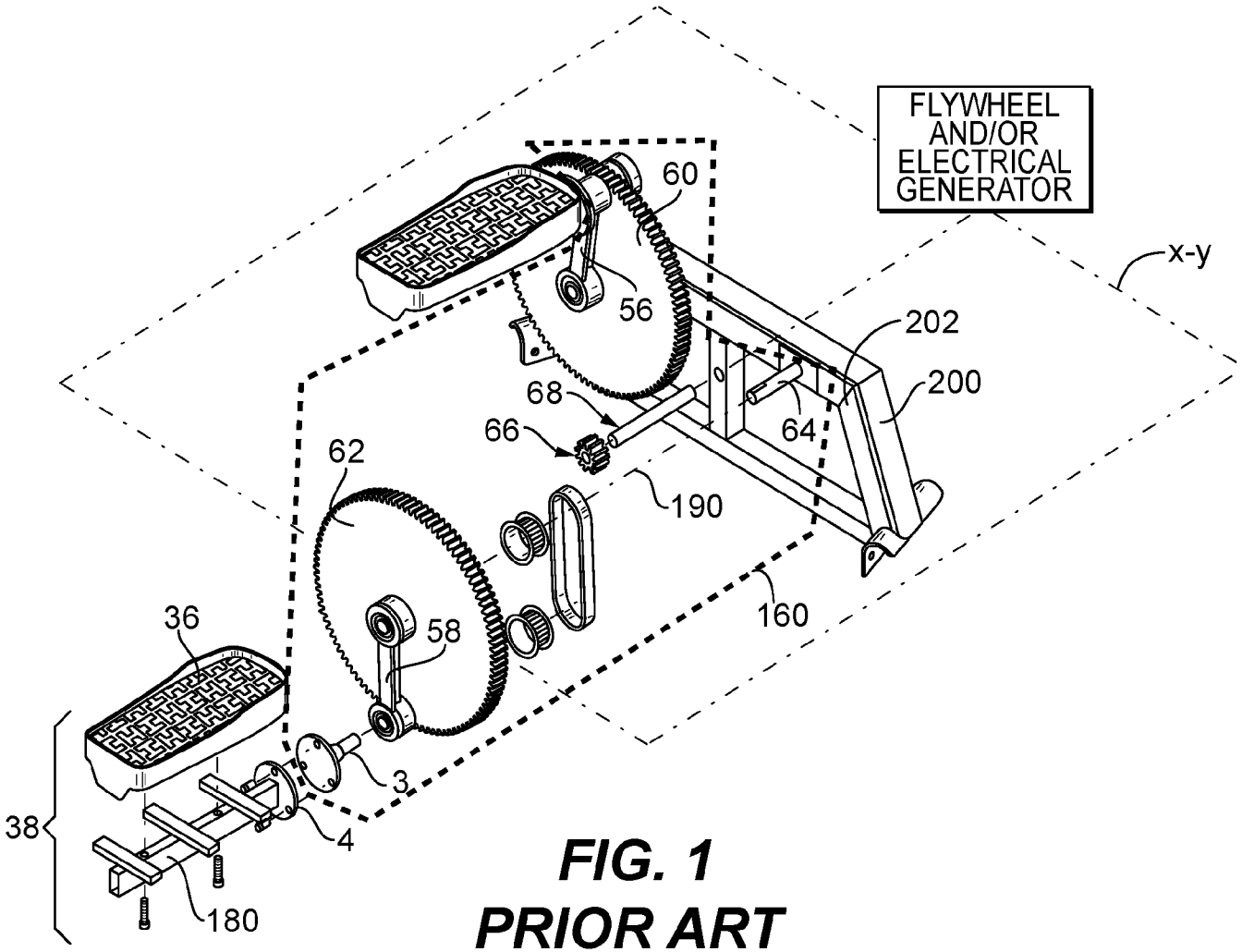
FIG. 1 PRIOR ART
FIG. 1 is a perspective view illustrating the pedals and pedal mounting assembly of a prior art exercise device in exploded format.

The following table provides a list of terms of art, along with their descriptions as used in this specification.

TABLE 1

Definitions of terms of art used in this specification.

| Term | Definitions |
|---|---|
| Abduct | move away from the center of the body; noun: abduction |
| Abductor | a muscle that accomplishes abduction, here of the leg |
| Adduct | move toward the center of the body; noun: adduction |
| adductor | a muscle that accomplishes adduction, here of the leg |
| anterior | Front |
| bilateral axis | imaginary line about which the two sides of the body rotate |
| bilateral axis plane | prior art terminology for the coronal plane |
| concentric contraction | activation of a muscle while the muscle is shortening |
| coronal plane | plane dividing the body into anterior and posterior parts |
| dorsal-ventral axis plane | prior art terminology for the sagittal plane |
| eccentric contraction | activation of a muscle while the muscle is lengthening |
| extension | increasing the angle between articulating bones |
| Flexion | decreasing the angle between articulating bones |
| frontal plane | alternative name for coronal plane |
| gluteus maximus | one of the hamstring muscles |
| gluteus medius | one of the hamstring muscles |
| hamstrings | a group of muscles of the upper leg that accomplish flexion of the leg |
| horizontal | parallel to the horizon or floor |
| inferior | Lower |
| Lateral | side; away from the midline |
| Medial | middle; toward the midline |
| medial sagittal plane | plane dividing the body into right and left halves, passing through the midline of the body |
| parallel to | not intersecting |
| perpendicular to | at a 90° angle to |
| posterior | Back |
| quadriceps | a group of four anterior muscles of the upper leg that accomplish extension of the leg |
| sagittal plane | plane dividing the body into right and left parts |
| superior | Higher |
| transverse plane | plane dividing the body into superior and inferior parts |
| vertical | perpendicular to the horizon or floor |
| vertical plane containing the user's bilateral axis | prior art terminology for the coronal plane |

The invention described and claimed in this specification is an improved exercise device that is configured to provide the benefits of lateral resistance to exercise the abductor and adductor muscles, while recruiting muscles involved in forward and backward motion of the foot and leg, in order to allow a user to maintain the lateral effort at reduced intensity when compared to that required by prior art exercise devices. The improved exercise device includes pedals mounted at an angle greater than 0° to the vertical providing for counter-rotating circular motion in a plane rotated at the same angle from a frontal plane of the user's body. While moving the pedals through their cycle of motion in this inclined plane, the user produces a motion parallel to both frontal and sagittal planes of the user's body. These improvements are accomplished by selectively modifying the orientation of the plane of the circular motion of the pedals.

Additional benefits are gained by inclining the plane of motion of the pedals. Leg motion through the sagittal plane requires extension and flexion of the leg. During flexion, when the foot moves toward the rear of the body, the hamstring muscles contract. During extension, when the foot moves toward the front of the body, the quadriceps and other extensor muscles contract. During a complete cycle of motion, these muscle groups experience both concentric and eccentric contraction. Thus, due to the addition of motion parallel to the sagittal plane, muscles in addition to the leg abductors and adductors are exercised more extensively than in prior art exercise devices. These muscles include the gluteus maximus, gluteus medius, and hip extensors responsible for raising the leg at the hip joint. A user exercising with the use of the improved device may experience increased functional range of motion. A user may also experience improved frontal plane movement compared to that experienced during use of prior art exercise devices. In addition, a user's hips may achieve a neutral or even an extended position.

Figure 2:
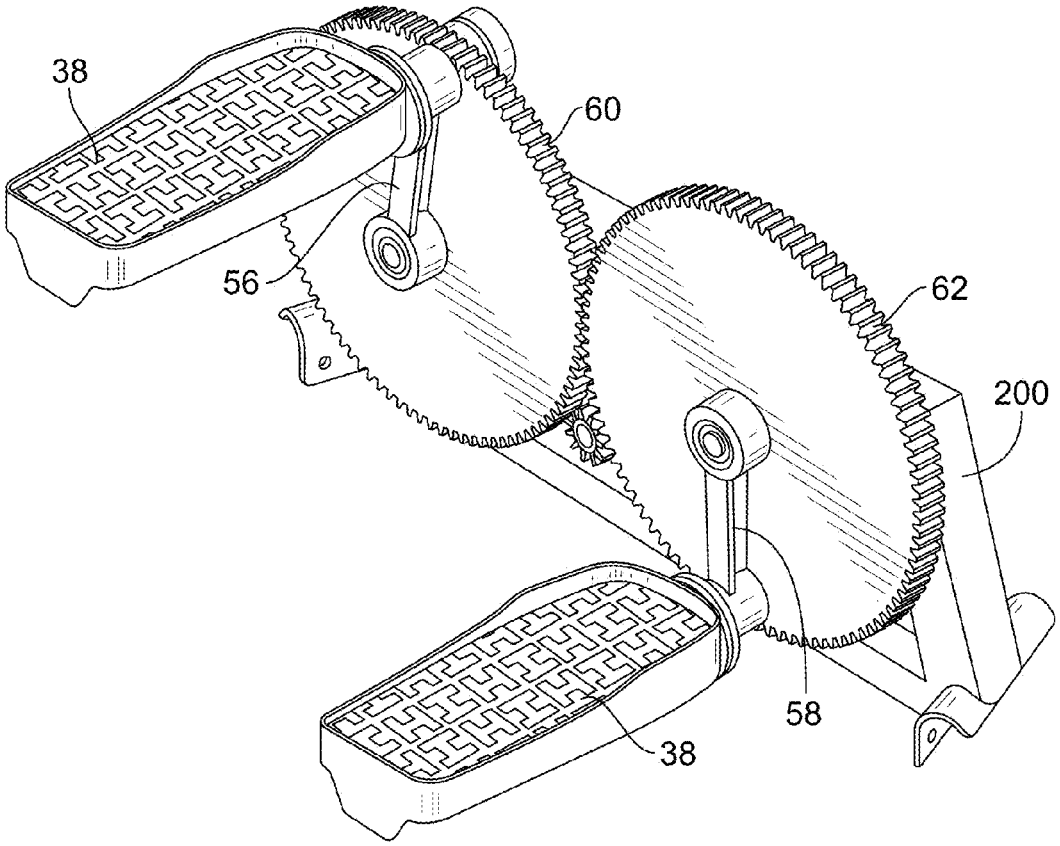
FIG. 2 PRIOR ART
FIG. 2 is an assembled perspective view of the prior art pedals and pedal mounting assembly of FIG. 1.

FIG. 1 is a perspective view illustrating the pedals (38) and pedal mounting assembly (160) of a prior art exercise device in exploded format. FIG. 2 is an assembled perspective view of the prior art pedals (38) and pedal mounting assembly (160) of FIG. 1 attached to a support frame (200). FIGS. 1 and 2 show a structure for providing linkage and auxiliary functions. In this approach, the pedal crank assemblies (56 and 58) are mounted directly on synchronizing gears (60 and 62), which mesh thereby turning together to provide the linking function. These gears and their associated pedal crank assemblies are mounted on and directly rotate about axles (64), each axle (64) fixed to a supporting frame (200) at its mounting surface (202) and having a centerline (190) which acts as the axis of rotation of the gear and associated pedal crank assembly mounted on the axle (64). Idler gear (66) is fixed to idler shaft (68) and engages with and is rotated by meshed gears (60 and 62). The consequent rotation of shaft (68) may be arranged to operate a generator and or flywheel, shown schematically, or any other appropriate device similar to the configuration illustrated in FIG. 1. Referring to FIGS. 1 and 2 of this disclosure, a mechanism particularly suited for employment in the present invention is shown in which two stand-upon counter rotating pedals (38) are attached to pedal crank assemblies (56 and 58) which are in turn mounted on meshed gears (60 and 62) rotatable on axles (64) all attached to an appropriate supporting frame (200). Each pedal (38) comprises a pedal surface (36) supported by a pedal support (180) which attaches to a pedal mount (4) which is in turn affixed to a pedal attachment piece (3).

In the prior art exercise device, a pedal mounting assembly (160 in FIGS. 1 and 7A) containing gears or sprockets and linkages responsible for constraining the motion of the pedals is affixed to the supporting frame (200) in an orientation that is parallel to the mounting surface (202) of the supporting frame. In particular, the pedal mounting assembly (160) comprises one pedal attachment piece (3) for each pedal which attaches to the respective pedal crank assembly (56 or 58) which is fixed to its respective gear (60 or 62) which in turn is attached at its centerline (190) to one of the two axles (64), each axle having a centerline (190). The pedal mounting assembly (160) may also comprise an idler gear (66) fixed to idler shaft (68), and additional gears, sprockets, and linkages as desired to cause gears 60 and 62 to rotate when force is applied to at least one pedal. The supporting frame (200) is oriented in a vertical position perpendicular to the horizontal plane (x-y). Pedals (38) are mounted perpendicular to the pedal mounting assembly (160 in FIGS. 1 and 7A) via pedal crank assemblies (56 and 58) such that their top surfaces (36) maintain an orientation parallel to the horizontal plane (x-y). Both the perpendicular orientation of the supporting frame (200) with respect to the horizontal plane (x-y) and the perpendicular orientation of the pedals (38) with respect to the pedal mounting assembly (160 in FIGS. 1 and 7A) are fixed in the prior art device.

Figure 3:
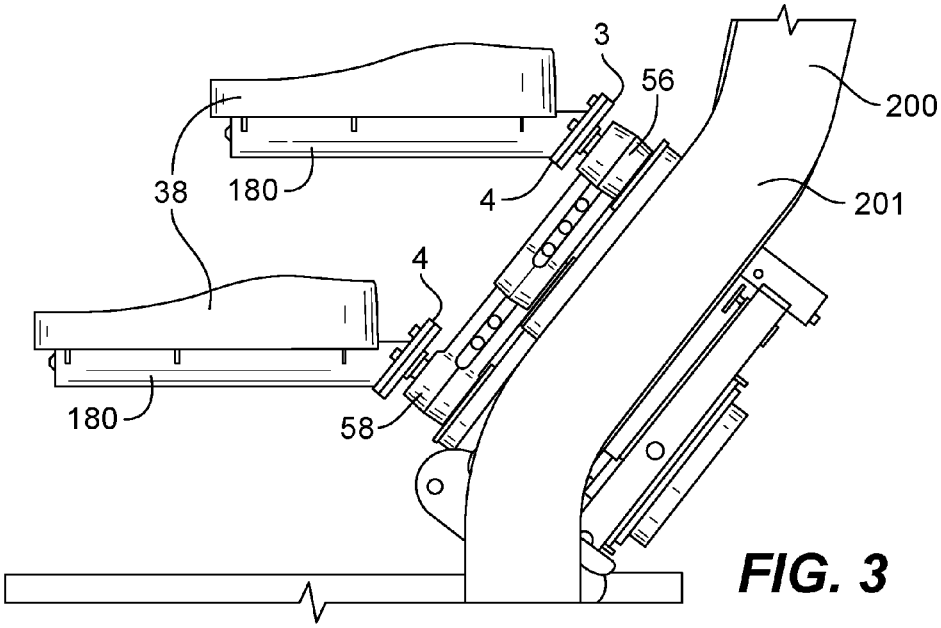
FIG. 3 is a side view of the present invention.
Figure 4:
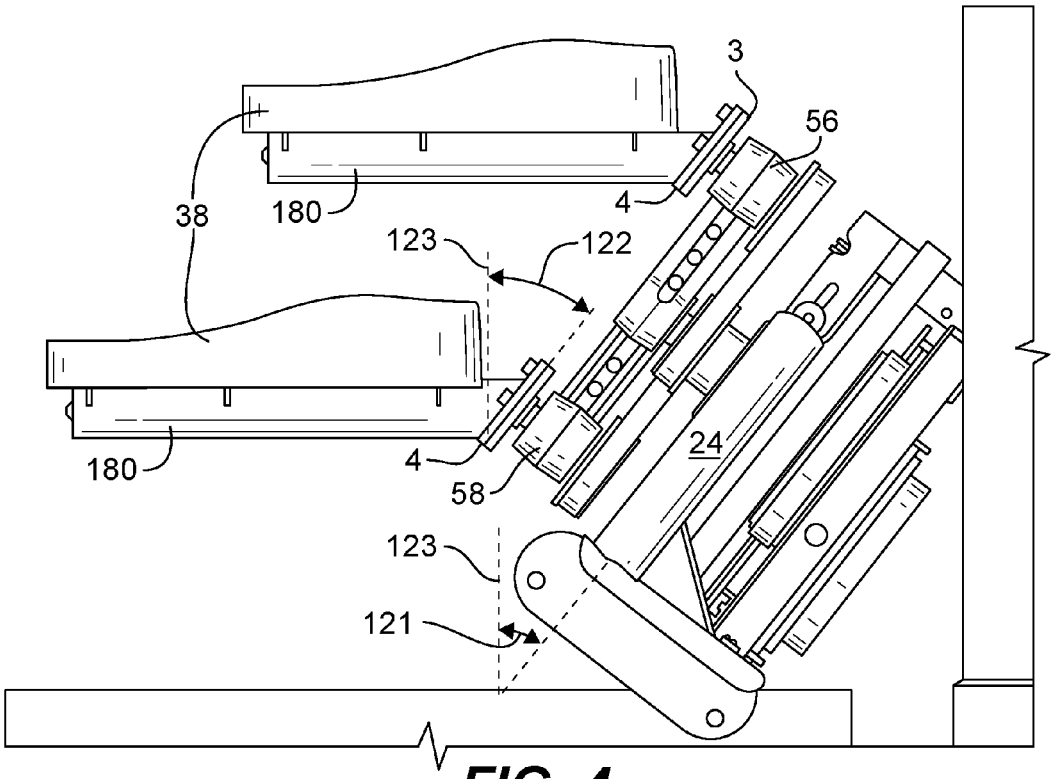
FIG. 4 is an additional side view of the present invention.

FIGS. 3 and 4 are side views of the disclosed invention showing alternative embodiments of the pedal mounting assembly (160) of the invention. Pedals (38) are mounted to pedal crank assemblies (56 and 58) at the pedal mount (4) with the pedal attachment piece (3), and the pedal crank assemblies (56 and 58) are attached to the rest of the pedal mounting assembly (160). As particularly shown in FIG. 4, the assembly tilt angle (121) is the angle between the plane defined by the front surface of the pedal mounting assembly (160) and the vertical (line 123). The attachment angle (122) is the angle between the plane in which the pedal mount (4) attaches to the pedal crank assembly (56 or 58) via the pedal attachment piece (3) and the vertical (line 123). As shown in the Figures, both the tilt angle and the attachment angle are measured from the vertical plane parallel to the frontal plane of the user toward the anterior section. In some embodiments the assembly tilt angle (121) is equal to the attachment angle (122). Each of the tilt angle (121) and the adjustment angle (122) may have values greater than 0° and less than or equal to 90°. A preferred range of values for the tilt and attachment angles (121 and 122) is greater than 0° and less than or equal to 45°. A particularly preferred value for the tilt angle and the attachment angle is 38°.

Taken as a whole, then, the improved exercise device may be seen as an improvement over the Snyderman '454 device, utilizing its pedal mounting assembly (160) by attaching the pedals (38) at an attachment angle (122) greater than 0° and less than or equal to 90° measured from the user's coronal plane toward the anterior section and attaching the pedal mounting assembly (160) to the supporting frame (200) at a tilt angle (121) greater than 0° and less than or equal to 90° measured from the user's coronal plane toward the anterior section such that the plane of rotation of the pedals (38) is rotated by an angle between 0° and 90° from the user's coronal plane toward the anterior section. In the improved exercise device, the shaft members of the first and second axles (64) are mounted to the frame at a mounting angle, the mounting angle having a value greater than 90° and less than or equal to 180° (which is equal to the sum of the tilt angle and 90°), the mounting angle measured between the user's coronal plane and the centerline of each of the first and second axles (64) toward the anterior section. This may be accomplished by having the axles mounted at an acute angle directly to a vertically oriented portion of the supporting frame (200) or by mounting them at a right angle (90°) to a section of the supporting frame (201) that is positioned at the tilt angle as measured from the user's coronal plane toward the anterior section (see FIGS. 3, 5, 8, and 9, for example). The pedal mount (4) of the Snyderman '454 device is also modified in the improved exercise device such that it attaches to the pedal attachment piece (3) at an attachment angle greater than 0° and less than or equal to 90° measured from the user's coronal plane toward the anterior section. The improvements over the Snyderman '454 device result in the plane of rotation of the first and second pedal members being rotated by an angle between 0° and 90° from the user's coronal plane toward the anterior section.

The tilt angle (121) may be fixed at the time of manufacture or assembly. In this embodiment the pedal mounting assembly (160) is attached to the supporting frame (200) along a portion of the supporting frame (201) that is inclined at a predetermined angle equal to the tilt angle (121) from the vertical plane. FIG. 4 depicts an embodiment of the invention in which the tilt angle (121) is fixed.

It may be desirable for the tilt angle (121) to be adjustable, either continuously or in predetermined increments, over a range of angles. To accommodate this adjustability, the supporting frame (200) may include a portion whose inclination from the vertical plane is variable, either continuously or in predetermined increments, over a range of angles (121). The pedal mounting assembly (160) is then affixed to the portion of the supporting frame (200) having the variable inclination. In an alternative embodiment, a mounting block (210) may be interposed between the supporting frame (200) and the pedal mounting assembly (160).

Figure 11:
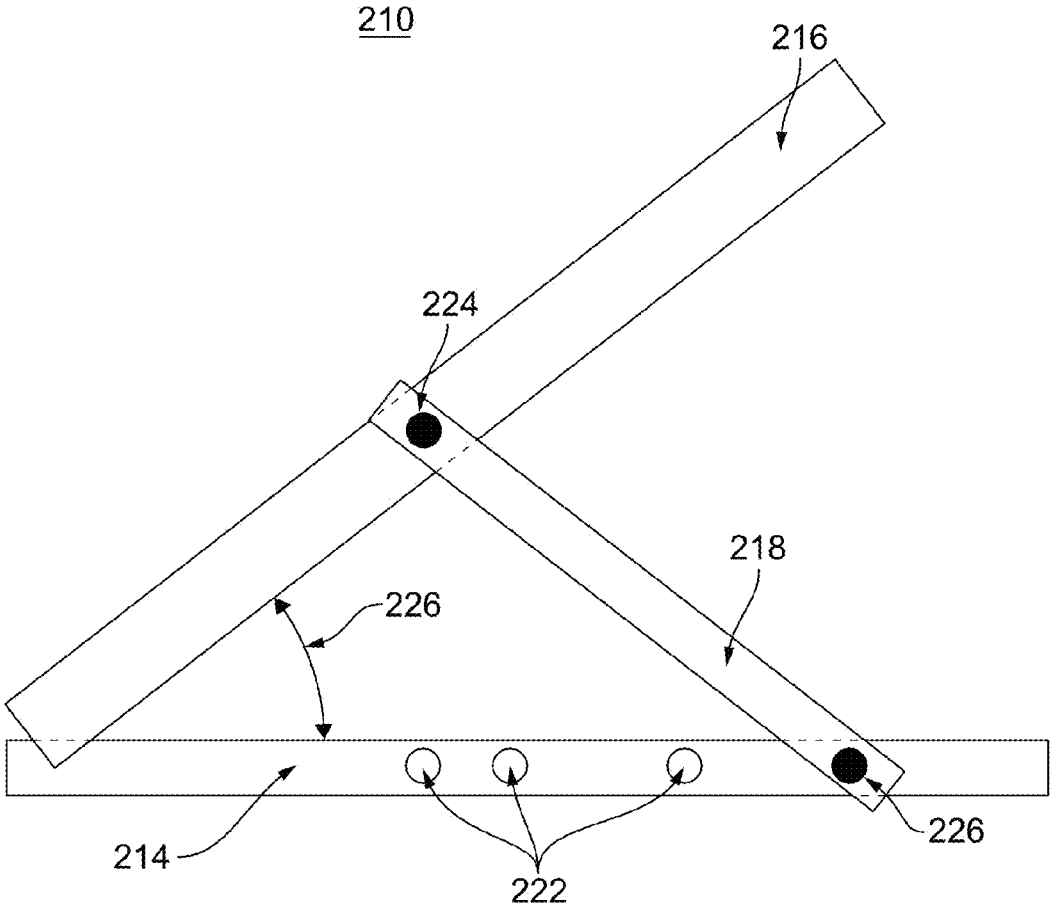
FIG. 11 depicts an exemplary mounting block for use with the present invention.

FIG. 11 depicts an example of a simple mounting block (210). The pedal mounting assembly (not shown) is affixed to the mounting member (216) of the mounting block (210). In the embodiment depicted in FIG. 11, the mounting block (210) further includes a horizontal member (214) and a prop (218). The mounting member (216) is secured to one end of the prop (218) via a pin (224). The horizontal member (214) may contain a series of holes (222) through which a pin (226) may be inserted to secure the other end of the prop (218). The angle (226) between the mounting member (216) and the horizontal member (214) of the mounting block (210) is complementary to the tilt angle (121).

In one embodiment, the attachment angle (122) may be fixed at the time of manufacture or assembly. In this embodiment, each pedal mount (4) is attached to the pedal mounting assembly (160) via pedal crank assemblies (56 and 58) at a predetermined angle (122) from the vertical (line 123). FIG. 4 depicts an embodiment of the invention in which the attachment angle (122) is fixed.

It may be desirable for the attachment angle (122) to be adjustable, either continuously or in predetermined increments, over a range of angles. To accommodate this adjustability, the angle (122) between the pedal support (180), on which the pedal (38) rests, and the pedal mount (4) must be variable. This may be accomplished, for example, by attaching the pedal mount (4) to the pedal support (180) by a joint having a variable angle.

Figure 12:
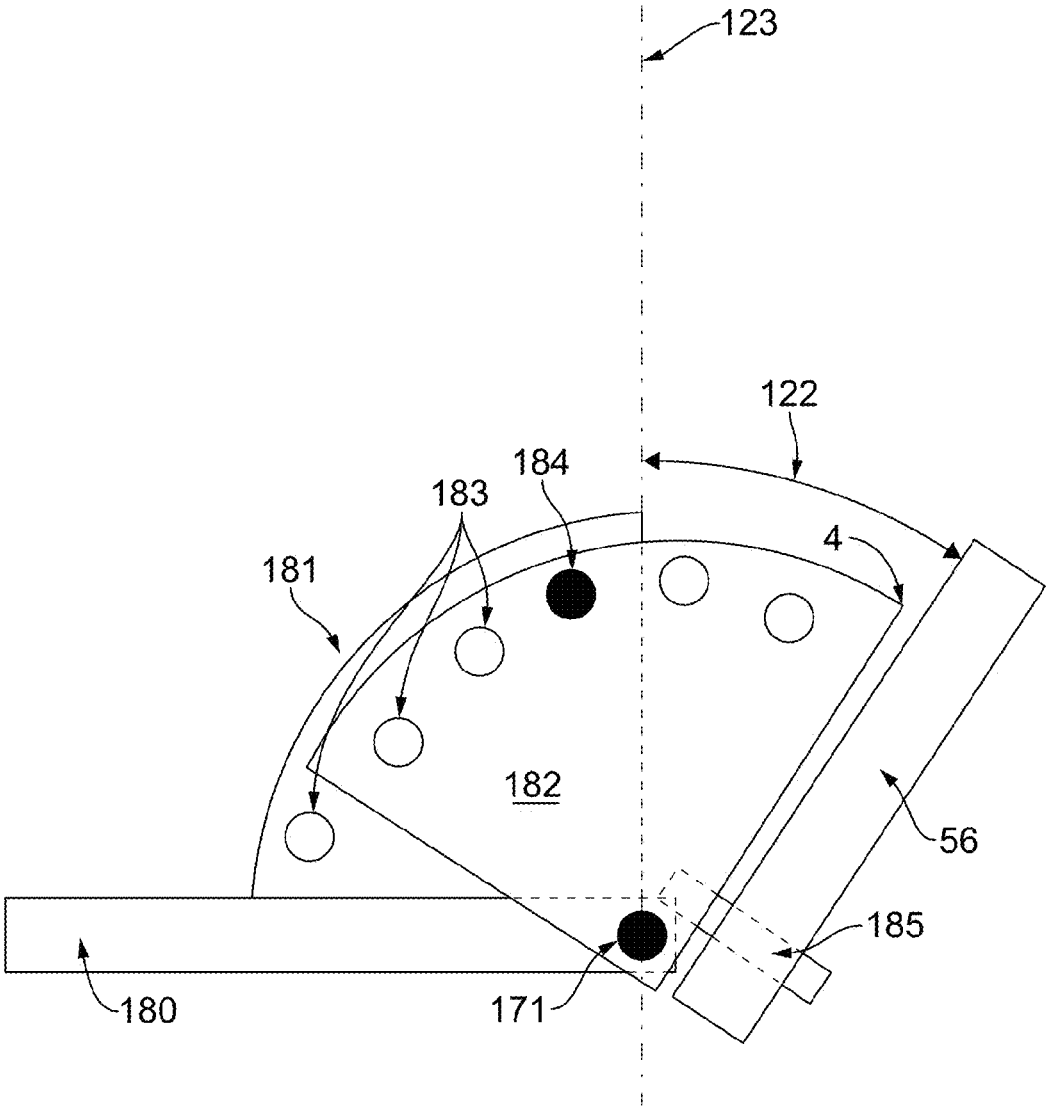
FIG. 12 depicts an exemplary mechanism for attaching a pedal mount to a pedal support shaft.

FIG. 12 depicts an embodiment in which the pedal mount (4) is attached to the pedal support (180) by a joint made of two circular sections (181 and 182). Each circular section (181 and 182) has a series of holes (183) passing through it near its outer edge. Piece 181 is attached to the pedal support and piece 182 is attached to the pedal mount (4), which is mounted to pedal crank assembly (56). An axle (185) passes through the pedal mount (4) and the pedal crank assembly (56). Pieces 181 and 182 are attached at a pivot point (171). When the desired angle between the pedal support (180) and the pedal mount (4) is achieved, pieces 181 and 182 are secured by a pin or other securing piece (184) through a pair of holes (183). The angle (122) between the surface of the pedal mount (4) and the vertical (line 123) is the attachment angle.

In some embodiments of the invention, the pedals (38) may be maintained in a horizontal orientation. To achieve this, the tilt angle (121) and the attachment angle (122) must be equal.

Figure 5:
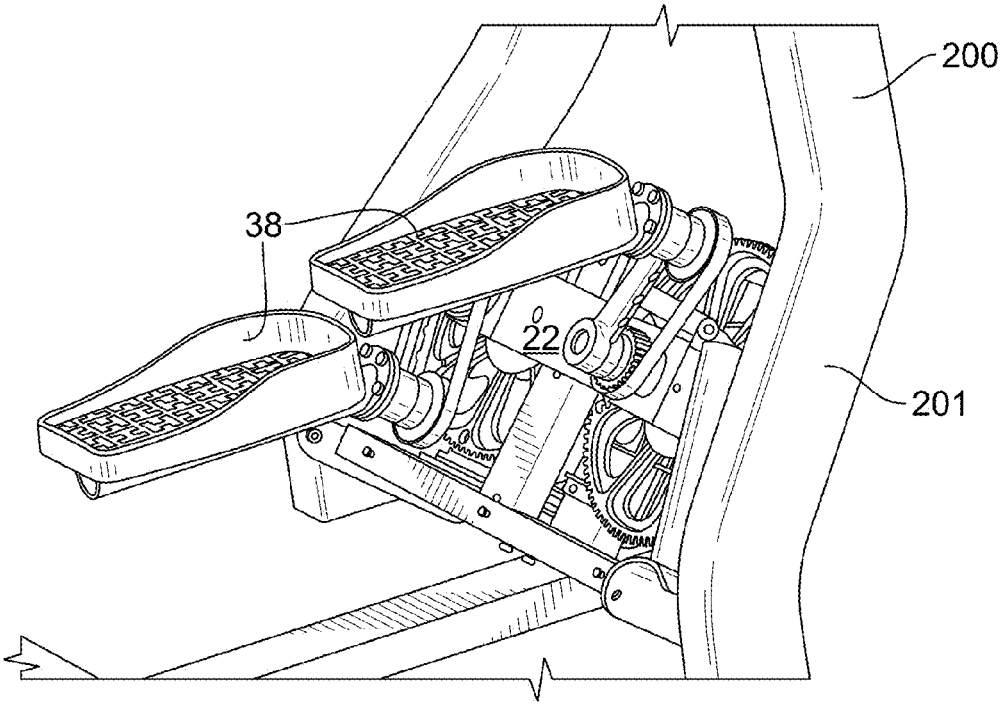
FIG. 5 is a perspective view of the present invention.

FIG. 5 is a perspective view of one embodiment of the invention in which the pedals (38) are displaced from a rest position. In this view the top surfaces of the pedals are seen to maintain an orientation parallel to the horizontal plane (x-y). At the point during the cycle of motion of the pedals (38) depicted, the right pedal is positioned above and forward of the left pedal. As a pedal (38) moves upward it also moves forward, moving the user's foot forward and requiring extension of the user's leg. As a pedal (38) moves downward it also moves backward, moving the user's foot backward and requiring flexion of the user's leg.

Figure 6:
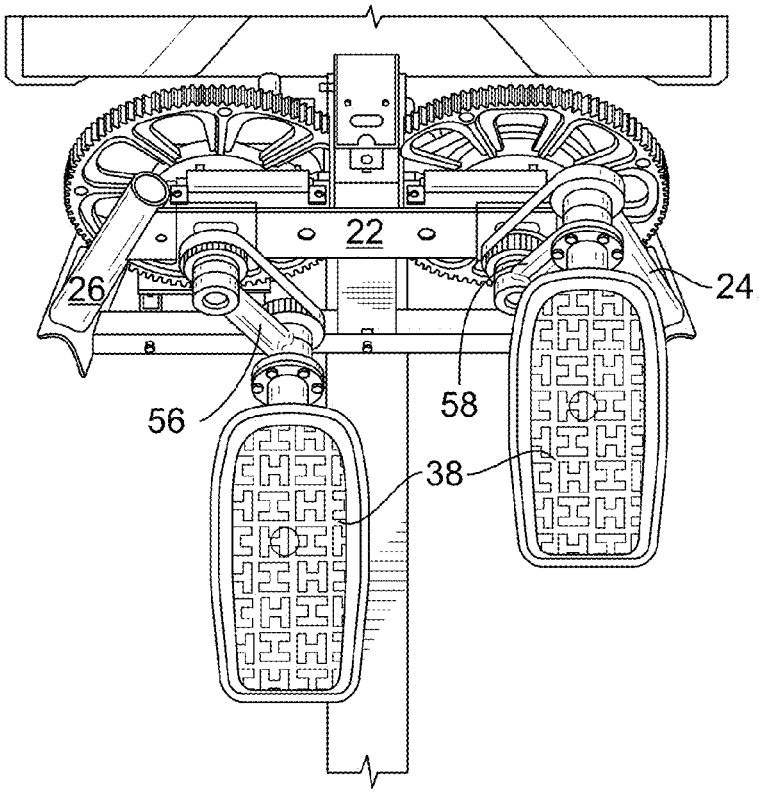
FIG. 6 is a top perspective view of the present invention.

FIG. 6 is a top perspective view of one embodiment of the invention in which the pedals (38) occupy the same positions as those depicted in FIG. 5. In this embodiment, pedals (38) are linked through gears, such that they pivot in opposite directions around their attachment points. As a result of this opposing motion, abduction and adduction of left and right legs are effected at the same point in the rotation cycle for each pedal (38). In other words, when the right pedal is moving clockwise the right leg is abducting as the right foot moves through the top portion of its cycle. Clockwise motion of the right pedal causes counterclockwise motion of the left pedal, and the left leg is abducting as the left foot moves through the top portion of its cycle. In this way, both legs abduct through the same portion of the cycle of motion. Similarly, both legs experience adduction through the same portion of their respective cycles of motion. The same is true when the right pedal moves counterclockwise and the left pedal moves clockwise.

FIG. 6 also shows an embodiment of a support frame including a crossbar (22), and diagonal uprights (24 and 26).

Figure 7A:
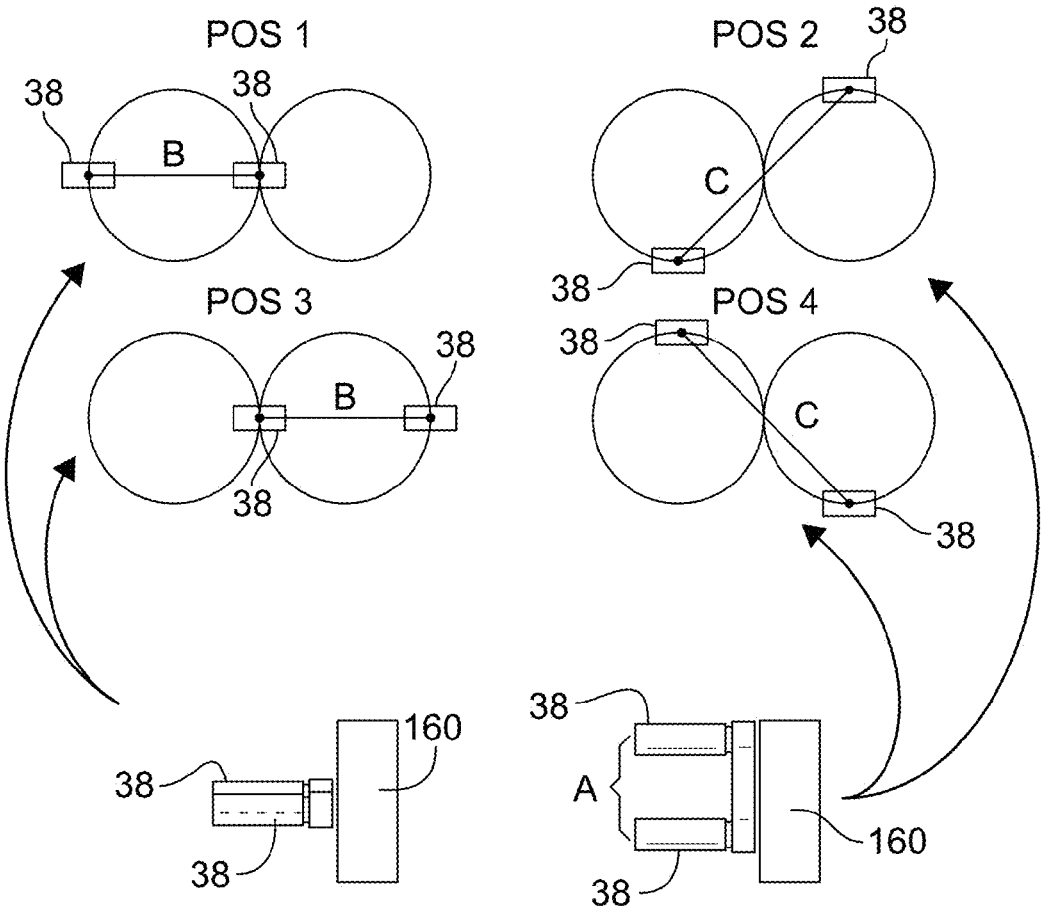
FIG. 7A PRIOR ART
FIG. 7A depicts the relative positions of a user's foot at four points of a cycle of motion during use of a prior art exercise device.

FIG. 7A depicts the relative positions of the pedals (38) at four points of a cycle of motion during use of a prior art exercise device. Positions 1, 2, 3, and 4 are viewed along a line perpendicular to the vertical plane (y-z) which is the plane of motion of the pedals. As the pedals (38) move through positions 1, 2, 3, and 4, the right pedal moves clockwise while the left pedal moves counterclockwise. All motion is confined to the vertical plane. The diameter of the circle described by the motion of a pedal (38) in the plane of motion is labeled A, and is equal to the maximum vertical displacement between the two pedals (38). The minimum horizontal distance between the pedals (38), labeled B and in this case equal to A, occurs when the pedals (38) are at equal heights (positions 1 and 3). The separation between the pedals (38) increases as they move from position 1 to position 2, and from position 3 to position 4. As shown in FIG. 7A the maximum separation between the two pedals (38) reaches C at positions 2 and 4, and includes horizontal and vertical components in the plane of motion.

Figure 7B:
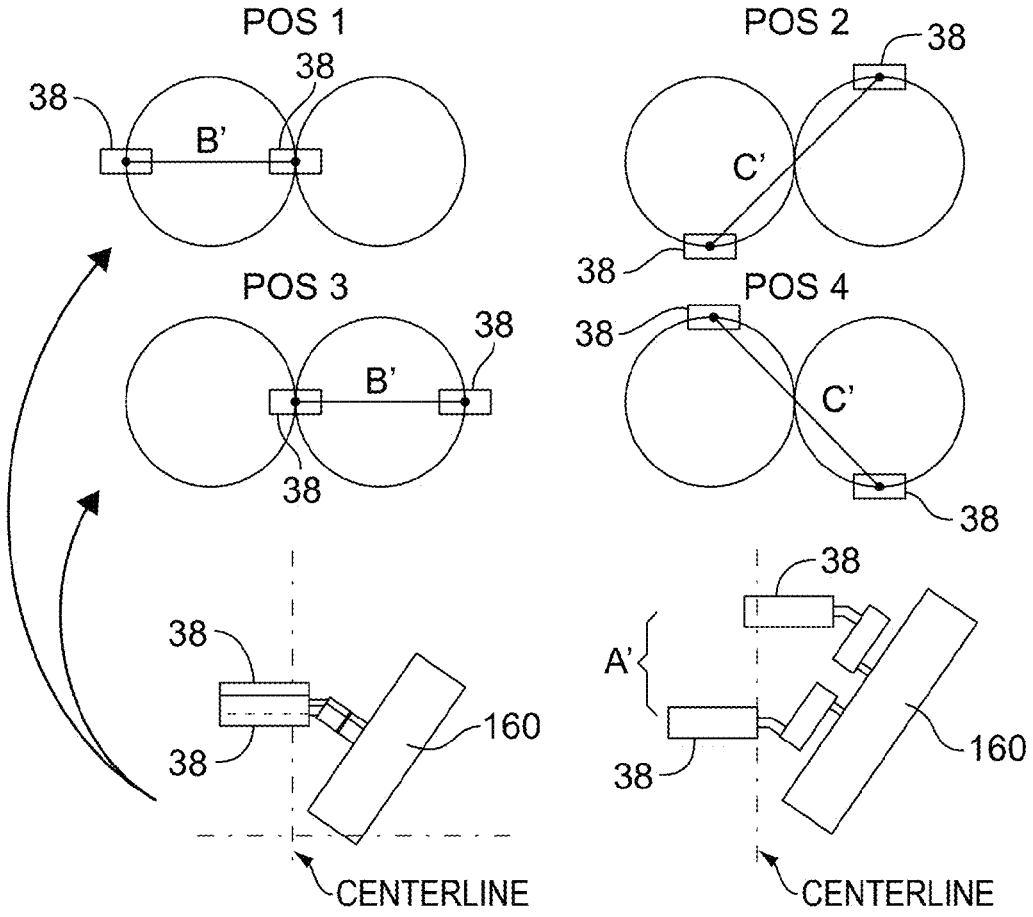
FIG. 7B depicts the relative positions of a user's foot at four points of a cycle of motion during use of the present invention.

FIG. 7B depicts the relative positions of the pedals (38) at four points of a cycle of motion during use of the present invention. Positions 1, 2, 3, and 4 are viewed along a line perpendicular to the vertical plane (y-z), which is not the plane of motion of the pedals. As the pedals (38) move through positions 1, 2, 3, and 4, the right pedal moves clockwise while the left pedal moves counterclockwise. In this device, the plane of motion is tilted with respect to the vertical by an angle equal to the attachment angle (122). Thus the amplitude of the vertical motion is reduced while a component of motion forward and backward with respect to the frontal plane is introduced. The maximum vertical distance between the pedals (38) is labeled A', the minimum horizontal distance between the pedals is labeled B', and the maximum separation between the two pedals in the vertical plane (y-z) is labeled C'.

Example

As illustrated in FIG. 7A depicting a prior art device, if the diameter of the circle described by the motion of a pedal (38) in the plane of motion, by way of example, is selected to be 15 inches, and the minimum distance between the pedals (38), which is also selected to be 15 inches, occurs when the pedals (38) are at equal heights (positions 1 and 3 in both figures), then by the Pythagorean theorem the maximum separation between the pedals (38) in the plane of motion is approximately 21.21 inches. Thus the value of A is 15 inches, the value of B is 15 inches, and the value of C is 21.21 inches.

By contrast, in an embodiment of the present invention depicted in FIG. 7B, if the plane of motion of the pedals (38) is tilted from the vertical by 38°, the diameter of the circle described by the motion of a pedal (38) in the plane of motion, by way of example, is selected to be 15 inches, and the value of B' is selected to be 15 inches, then the value of A' is approximately 11.4 inches and the value of C' is approximately 18.84 inches. By inclining the plane of motion of the pedals (38) from the vertical plane (y-z) the maximum vertical separation between the pedals (38) is reduced. These specific dimensions have been chosen for the purpose of this example only, to illustrate concretely the different components of motion and relative dimensions. These exemplary dimensions are not meant to limit the dimensions of any particular embodiment of the invention in any way.

In general, the diameter of the circle described by the motion of a pedal (38) is determined by the length of the pedal crank assembly (56 or 58) (also called a "crank arm") between its axis of rotation (190) about an axle (64) and the point or pivot (171) at which it is attached to the pedal (38). This length may be fixed at the time of manufacture or assembly of the exercise device. It may be desirable for this length to be adjustable to accommodate variations in the dimensions of the bodies of different users. In this embodiment the length may be made adjustable by, for example, forming the pedal crank assembly (56 or 58) of two or more interlocking pieces that may be mutually affixed at different points along their respective lengths. Regardless of the particular length to which the pedal crank assembly (56 or 58) is adjusted, the pedals (38) will always move in a circular path because the length of the pedal crank assembly (56 or 58) remains constant while the exercise device is in use.

Figure 8:
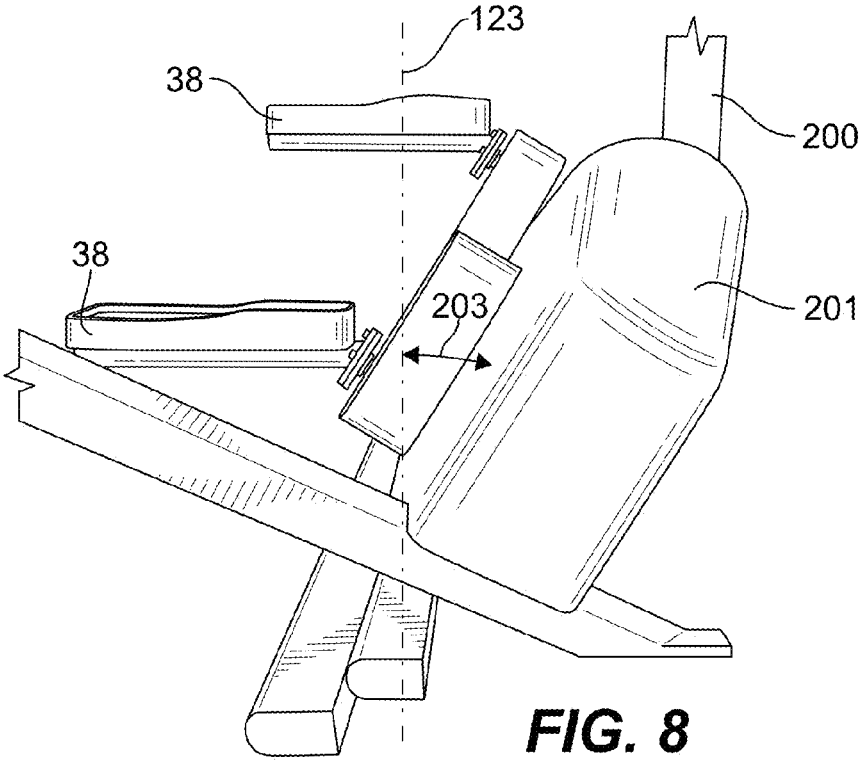
FIG. 8 is an illustration of a prototype of the present invention.

FIG. 8 is an illustration of a prototype of an exemplary embodiment of the disclosed invention. As may be clearly seen, it is not necessary for the entire supporting frame of the exercise device to be inclined at any particular angle. In this embodiment, the part (201) of the supporting frame (200) to which the pedal mounting assembly (160) is attached makes a larger angle (203) with the vertical (line 123) than does the part (not shown in FIG. 8) of the supporting frame (200) on which a user may rest the upper body.

Figure 9:
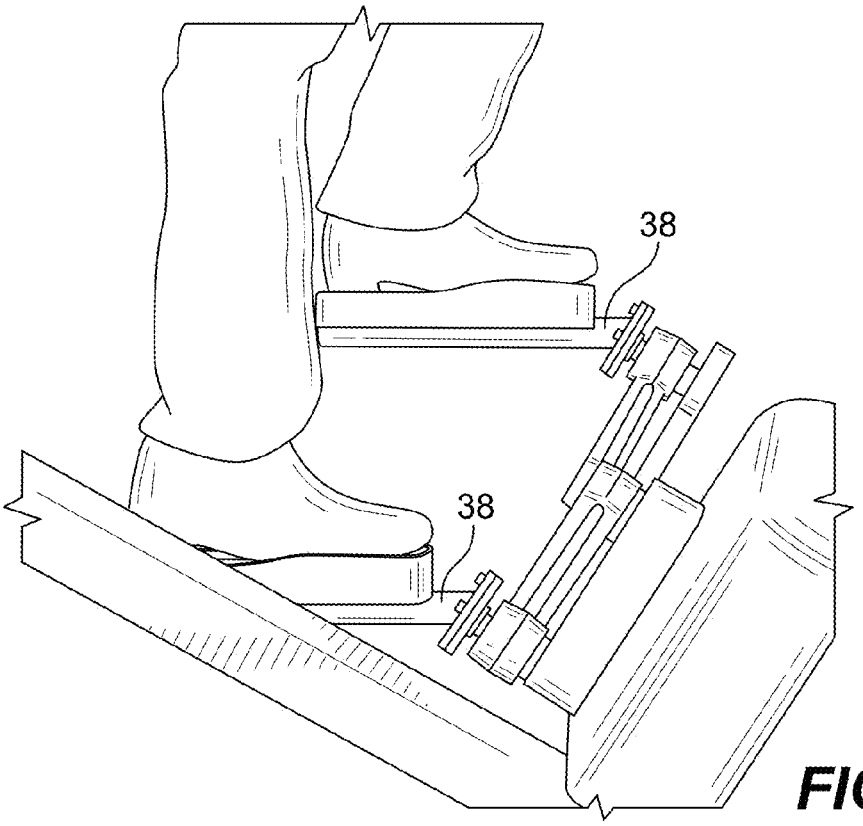
FIG. 9 is an illustration of the present invention in use.

FIG. 9 is an illustration of an exemplary embodiment of the invention in use. As can be seen, the pedals (38) that support the user's feet remain parallel to the horizontal plane (x-y) during use of the exercise device.

Figure 10:
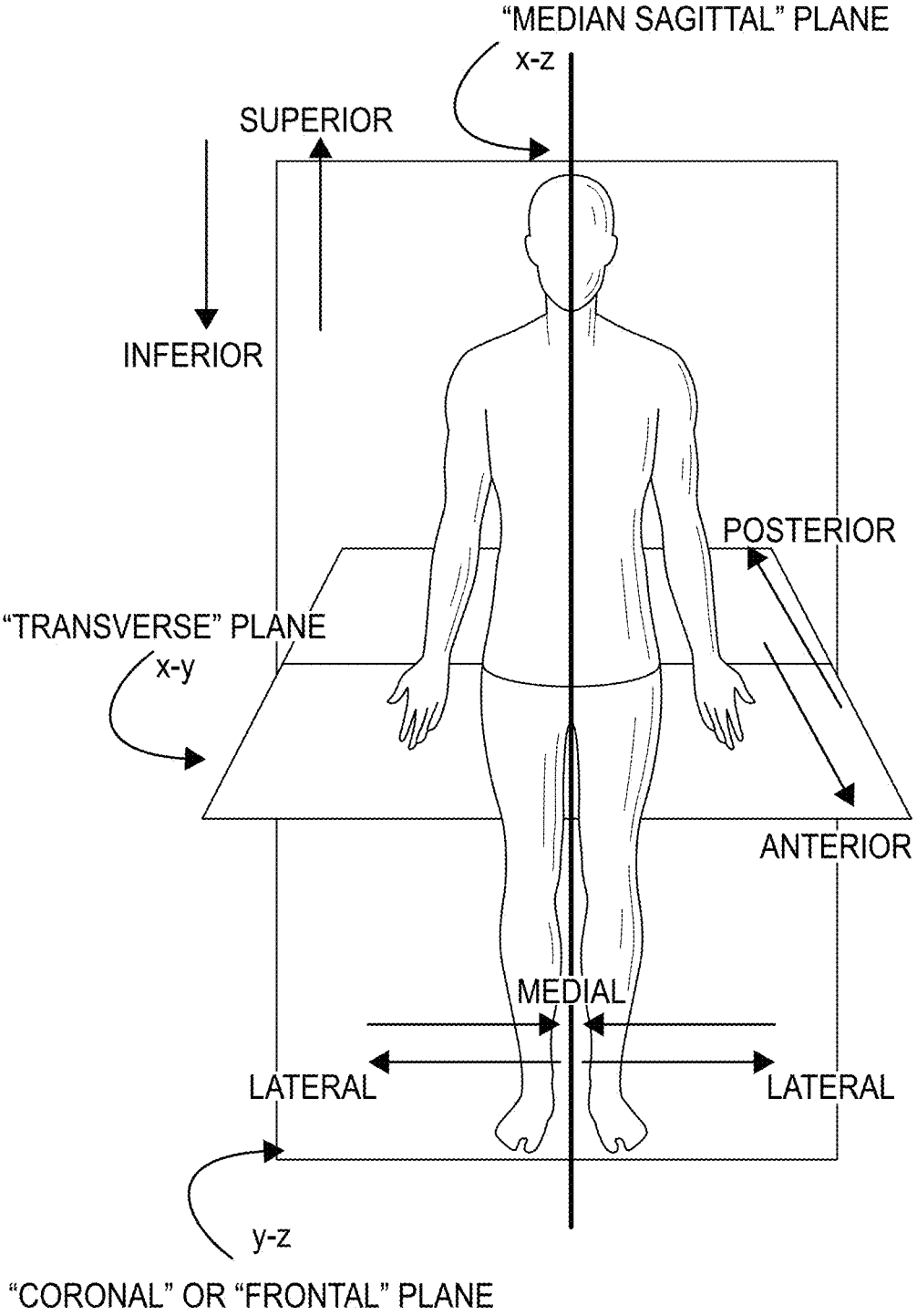
FIG. 10 is a diagram illustrating the physiological terms used in this specification.

FIG. 10 is a diagram illustrating the physiological terms used in this specification. The median sagittal plane (x-z) separates the body into right and left halves. In FIG. 10 the median sagittal plane appears as a vertical line. Movement toward the median sagittal plane, adduction, is medial movement. Movement away from the median sagittal plane, abduction, is lateral movement. The transverse plane (x-y) separates the body into superior (upper) and inferior (lower) parts. When a user is fully erect, the transverse planes of the body are parallel to the horizontal plane (x-y). The coronal or frontal plane (y-z) separates the body into anterior (front) and posterior (back) parts. When a user is fully erect, the frontal planes of the body are parallel to the vertical plane (y-z).

While the above is a description of what are presently believed to be the preferred embodiments of the invention, various alternatives, modifications, and equivalents may be used. Those skilled in the art will realize that other and further embodiments can be made without departing from the spirit of the invention, and it is intended to include all such further modifications and changes as come within the true scope of the following claims. Therefore, the above description should not be taken as limiting the scope of the invention, which is defined solely by the claims.

The invention claimed is:

1. An exercise device configured for use by a user, the exercise device comprising: a supporting frame; a pedal mount assembly attached to the supporting frame at a tilt angle to a vertical plane parallel to a plane passing through a frontal plane of the user's body, the tilt angle having a value greater than 0° and less than or equal to 90°; two pedal supports, each of the two pedal supports affixed to the pedal mounting assembly via a respective pedal crank assembly at an attachment angle, the attachment angle having a value greater than 0° and less than or equal to 90°, the two pedal supports parallel to one another; and two pedals, each of the two pedals attached to and supported by a respective one of the two pedal supports, the two pedals providing for counter-rotating circular motion in a plane rotated at the attachment angle to the vertical plane parallel to the plane passing through the frontal plane of the user's body.

2. The exercise device of claim 1, wherein the value of the attachment angles and the value of the tilt angle are equal.

3. The exercise device of claim 2, wherein the value of the attachment angles and the value of the tilt angle are greater than 5° and less than or equal to 45°.

4. The exercise device of claim 3, wherein the value of the attachment angles and the value of the tilt angle are equal to 38°.

5. The exercise device of claim 1, wherein: each of the respective pedal crank assemblies is configured to maintain a fixed distance between the respective pedal support of the two pedal supports attached thereto and an axis of rotation of the respective pedal crank assembly.

6. The exercise device of claim 5, wherein the fixed distance is adjustable.

7. A method of exercise, the method comprising: applying a force to one of the two pedals of the exercise device of claim 1, the applied force being sufficient to cause rotation of the pedal crank assembly to which the one pedal is attached about an axis of rotation of the pedal crank assembly.

8. The exercise device of claim 1, wherein the value of the attachment angle is adjustable.

9. The exercise device of claim 1, wherein the value of the tilt angle is adjustable.

* * * * *